US006122782A

United States Patent [19]

Chedid

[11] Patent Number: 6,122,782

[45] Date of Patent: Sep. 26, 2000

[54] BEDCLOTHES

[76] Inventor: Katie Chedid, C/- 31 Gow Street, Padstow, NSW, Australia, 2211

[21] Appl. No.: 09/180,064

[22] PCT Filed: Apr. 30, 1997

[86] PCT No.: PCT/AU97/00257

§ 371 Date: Oct. 29, 1998

§ 102(e) Date: Oct. 29, 1998

[87] PCT Pub. No.: WO97/40726

PCT Pub. Date: Nov. 6, 1997

[30] Foreign Application Priority Data

Apr. 30, 1996 [AU] Australia ..... PN9602

[51] Int. Cl.[7] ..... A47G 9/00

[52] U.S. Cl. ..... 5/495; 5/497; 5/498; 5/499; 5/494

[58] Field of Search ..... 5/482, 485, 494, 5/497, 498, 499, 495

[56] References Cited

U.S. PATENT DOCUMENTS

| | | | |
|---|---|---|---|
| 2,637,049 | 5/1953 | Kromer et al. | 5/497 |
| 2,695,414 | 11/1954 | Ford et al. | 5/485 |
| 3,243,827 | 4/1966 | Kintner | 5/482 |
| 3,694,832 | 10/1972 | Jamison | 5/497 |
| 3,868,735 | 3/1975 | Ross | 5/497 |
| 4,461,048 | 7/1984 | Allaire | 5/497 |
| 4,698,865 | 10/1987 | Walker | 5/497 |
| 4,937,904 | 7/1990 | Ross | 5/497 |
| 5,042,098 | 8/1991 | Stultz | 5/495 |
| 5,084,929 | 2/1992 | Staudinger | 5/494 |
| 5,177,821 | 1/1993 | Kawtoski | 5/497 |

FOREIGN PATENT DOCUMENTS

| | | | |
|---|---|---|---|
| 573089 | 11/1986 | Australia | A47G 9/04 |
| 7-079849 | 3/1995 | Japan | A47G 9/02 |
| 7-236556 | 9/1995 | Japan | A47G 9/02 |
| 8-080241 | 3/1996 | Japan | A47G 9/02 |
| 2191088 | 12/1987 | United Kingdom | A47G 9/02 |

*Primary Examiner*—Terry Lee Melius
*Assistant Examiner*—Fredrick Conley
*Attorney, Agent, or Firm*—Klein & Szekeres, LLP

[57] ABSTRACT

A fitted sheet includes a sheet body portion made of a flexible sheet material. The body is generally rectangular in shape, defining a first end, two sides and a second end opposite to the first end. A pair of generally triangular slots is formed in the first end. The triangular slots being disposed substantially symmetrically either side of a longitudinal axis (12) passing through the center of the first end and the center of the second end, and they are spaced apart a distance X. The triangular slots define an open end and two opposite sides, each side having an approximate length Y wherein the length Y is the same order of magnitude as length X. The opposed sides of each triangular slot (28A, 28B), (30A, 30B) are stitched to provide an engagement with the end of a suitably sized mattress. The area of sheet adjacent the engaged mattress end is not held against the upper surface of the mattress, so that the sheet can pivot away from the mattress.

14 Claims, 3 Drawing Sheets

BEDCLOTHES

BACKGROUND OF THE INVENTION

This invention relates to bedclothes.

As used in this specification the term bedclothes includes coverings for a bed, sheets, blankets, bedspreads, doona (duvet) covers, bed linen and similar goods.

Bedclothes commonly available on the market includes bed covers, fitted bottom sheets, flat sheets, blankets, doonas, and doona covers.

Although improvements have been made to bedclothes in the past, such as the introduction of fitted bottom sheets and the introduction of doonas, making a bed, particularly if blankets are to be used and particularly for less physically able people such as elderly people and those suffering from illnesses, can be surprisingly strenuous.

Further, in the case of institutions such as hotels which provide a large number of beds whose bedclothes often require changing daily, bedclothes which is easier to put on and take off would improve efficiency.

Also some items of bedclothes, particularly doonas have a tendency to slip and move around on the bed, in use, and may even slide off the bed completely. This problem can in some cases be alleviated by putting a heavy eiderdown or bedcover over the doona, however that is an unsatisfactory solution since the bed becomes too warm and the eiderdown prevents the freedom of movement which is one of the important benefits normally arising from using a doona.

Numerous attempts have been made to solve perceived problems with bedclothes. For example, AU A 57679/86, in the name of Dunlop Olympic Ltd is directed to a bottom fitted sheet for a mattress which is designed to fit particularly snugly to the mattress.

U.S. Pat. No. 4,698,865 relates to a "contour bed sheet". The principal object of the invention disclosed in that document is to provide a sheet which does not require any elastic to attach the sheet to a mattress. The specific embodiment describes a number of bottom sheets which by virtue of the way the sheets are cut and sewn provide rectangular box-like end portions which can engage an end of a mattress.

However, if either of the two above-described systems were used for a top sheet, problems would arise in keeping the top sheet on the mattress, since it would be engaged at only one end. Also, comfort for the user would be insufficient as the top sheet would be held tightly against the mattress allowing insufficient room for a persons foot under the top sheet at the base of the mattress.

U.S. Pat. No. 5,177,821 is directed to solving this problem. It discloses a bed sheet combination in which a billowy area at the bottom of a sheet is created to loosely receive feet. However, this solution has not been successful possibly due to its complexity of design and consequent relatively high manufacturing costs compared with a flat sheet.

U.S. Pat. No. 5,042,908 is also concerned with solving the problem of insufficient space for a user's feet under a fitted top sheet. That document discloses a sheet having a pleat across the foot end. Making pleats is expensive and the sheet shown in U.S. Pat. No. 5,042,908 would be expensive to manufacture and uncompetitive with flat sheets.

Thus despite a number of attempts to make a fitted top sheet, currently only fitted bottom sheets are commercially available since the attempts made to date to provide a fitted top sheet have proven unsatisfactory.

SUMMARY OF THE INVENTION

It is an object of the present invention to address and alleviate the problems of prior art types of bedclothes. One particular feature of the invention is to provide a fitted top sheet. An other particular feature is to provide an improved duvet/duvet cover Thus, according to a first aspect of the present invention there is provided an item of bedclothes which includes at one end a mattress engaging means which is adapted to engage over one end of a mattress of an appropriate size, the mattress engaging means comprising flexible sheet material which is generally rectangular in shape defining a first end, two sides and a second end opposite to the first end;

characterised in that a pair of generally triangular slots is formed in the first end, the triangular slots being disposed substantially symmetrically either side of a longitudinal axis passing though the centre of the first end and the centre of the second end, and being spaced apart by a distance X, the triangular slots defining an open end and two opposite sides each side having an approximate length Y wherein the length Y is of the same order of magnitude as length X;

means for joining together the opposed sides of each triangular slot to form an engagement means for engaging over the end of a suitably sized mattress; and wherein the engagement means is attached to or integral with an item of bedclothes, the arrangement being such that when the engagement means is engaged on one end of a mattress, the area of sheet material above the mattress adjacent the engagement means is not pulled against the upper surface of the mattress by the engagement means so that that area of the sheet material is free to pivot away from the mattress, about an axis defined at the extreme edge of the end of the mattress at which the engagement means is attached, and wherein the engagement means is retained on the mattress partly by tension in the engaging means which extends generally transversely across the mattress, the opposite end of the bedclothes being free from any such engagement means.

In a preferred embodiment the angle included between the two opposed sides of each triangular slot is 80 to 120°, preferably 100°.

It is preferred that corner portions of the first end are cut out along a line extending from each side at an angle of 20° to 40° to the longitudinal axis of each side, to the end, at or adjacent the outer side of the triangular cut out portion, thus defining two angled edge lines, and elastic or the like is applied along the end and along each angled edge line and the elastic is tensioned to reduce the length of the edge lines and end by 5 to 15%.

Conveniently, the length Y is between one half and two times the length X, preferably approximately the same length as length X.

Typically length Y will be greater than 20 cm, and preferably 20 to 25 cm.

In one embodiment the item is a sheet and the mattress engaging means are defined by appropriately cutting and stitching one end of the sheet, and applying elastic to one end of the sheet. Thus a related aspect of the invention provides a fitted sheet comprising:

a sheet body portion made of a flexible sheet material which is generally rectangular in shape defining a first end, two sides and a second end opposite to the first end;

characterised in that a pair of generally triangular slots is formed in the first end, the triangular slots being disposed substantially symmetrically either side of a longitudinal axis passing though the centre of the first end and the centre of the second end, and being spaced apart by a distance x, the triangular slots defining an open end and two opposite sides each side having an approximate length Y wherein the length Y is of the same order of magnitude as length X;

means for joining together the opposed sides of each triangular slot to form an engagement means for engaging over one end of a suitably sized mattress, the arrangement being such that when the fitted sheet is engaged on the one end of the mattress, the area of sheet disposed above the mattress adjacent the engagement means is not pulled against the upper surface of the mattress by the engaging means so that the sheet is free to pivot about an axis defined at an extreme edge of the end of the mattress on which the engagement means is fixed.

It is preferred that the corner portions of the first end are cut out along a line extending from each side at an angle of 20° to 40° to the longitudinal axis of each side, to the end, at or adjacent the outer side of the triangular cut out portion, thus defining two angled edge lines, and elastic or the like is applied along the end and along each angled edge line and the elastic is tensioned to reduce the length of the edge lines and end by 5 to 15%, preferably about 10%.

In an alternative embodiment the item is a duvet cover and the mattress engaging means are integral with, or attached to, the duvet cover The invention also provides A method of making an item of bedclothes as claimed in any preceding claim characterised by:

taking a sheet of material and selecting an end of that sheet material which is to form a mattress engaging means;

cutting two spaced v-shaped triangular areas of material from the chosen end of the sheet of material, the v-shaped cut-out portions being generally symmetrically arranged about a longitudinal axis passing through the center of the mattress engaging end and an opposite side of the sheet;

joining the opposed sides of each v-shaped portion to together so that the selected end portion of the mattress is of a reduced length substantially corresponding to the distance between the v-shaped cut-out portions; and applying elastic or the like along the selected end and along part of the sides of the sheet adjacent the selected end and tensioning the elastic; and the arrangement being such that when the engagement means is attached to or integral with an item of bedclothes, and the engagement means is engaged on one end of a mattress, the area of sheet material above the mattress adjacent the engagement means is not pulled against the upper surface of the mattress by the engagement means so that the area of sheet material is free to pivot away from the mattress, about an axis defined at the extreme edge of the end of the mattress at which the engagement means is attached, and wherein the engagement means is retained on the mattress partly by tension in the engaging means which extends generally transversely across the mattress, the opposite end of the bedclothes being free from any such engagement means.

Conveniently, the edges of the v-shaped portion are joined by stitching them together and the sheet is turned inside out before the elastic is applied.

The method may be further characterised by cutting off corner portions of the first end along a line extending from each side at an angle of 20° to 40° to the longitudinal axis of each side, to the end, at or adjacent the outer side of the triangular cut out portion, thus defining two angled edge lines, and applying the elastic or the like is applied along the end and along each angled edge line and tensioning the elastic to reduce the length of the edge lines and end by 5 to 15%.

The present invention can be used with blankets and doona covers as well as sheets. The mattress engaging means can either be formed from the material forming the blanket or doona cover itself or may be separately formed of sheet material which is then attached to the doona cover or blanket.

BRIEF DESCRIPTION OF THE DRAWINGS

A specific embodiment of the invention will now be described by way of example only and with reference to the accompanying drawings in which.

DETAILED DESCRIPTION OF THE INVENTION

Figure 1:
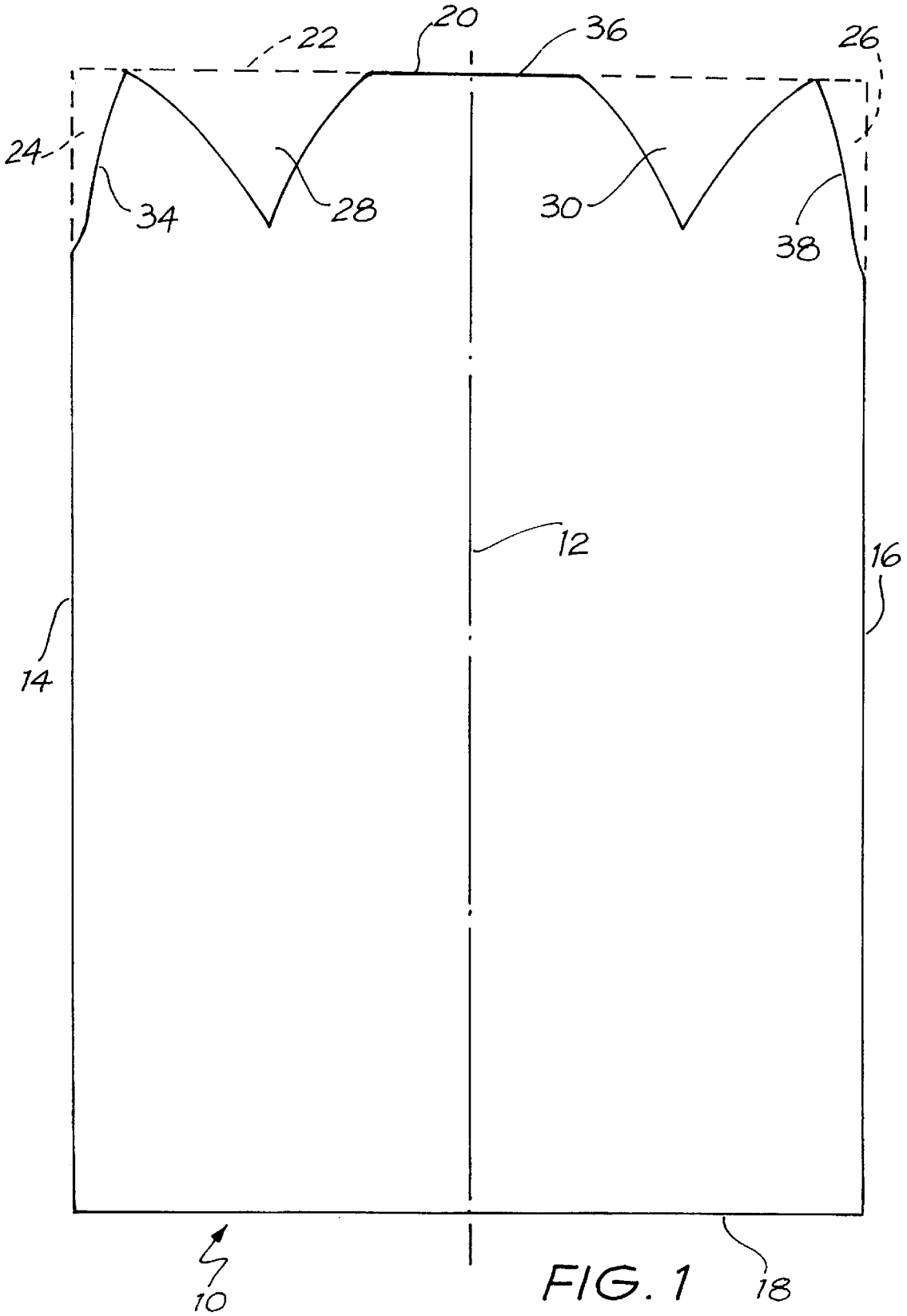
FIG. 1 illustrates a sheet cut according to a template for forming a fitted sheet embodying the present invention.

Turning to the drawings, FIG. 1 shows a sheet 10 which has been cut according to a pattern prior to making a fitted top sheet. As can be seen from the Figure, the pattern is generally symmetrical about a longitudinal axis 12 of the sheet 10. The sheet is generally rectangular and defines two opposed generally longitudinally extending sides or edges 14 and 16, and two opposed laterally extending sides, or ends 18 and 20.

The sheet was originally rectangular as indicated by the phantom lines 22. Portions of the originally rectangular sheet have been cut away at end 20 to form the pattern shown. As can be seen in FIG. 1, triangular portions 24 and 26 have been cut away from the corners of the sheet to define edges 34 and 38 respectively and two spaced v-shaped or triangular portions 28 and 30 have been cut-out from side 20 of the sheet. The v-shaped portions are symmetrically disposed either side of the longitudinal axis 12.

Figure 2:
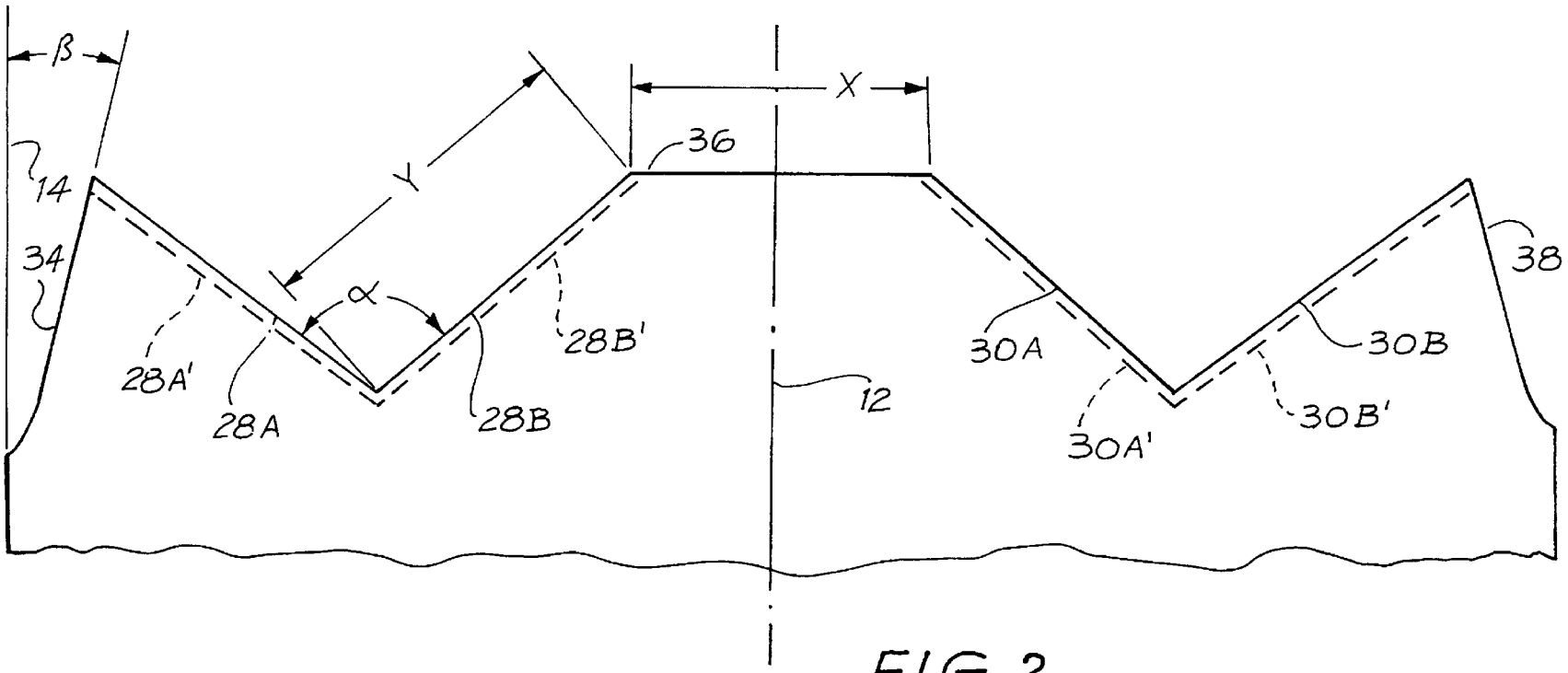
FIG. 2 is an enlarged view of one end of the sheet shown in FIG. 1.

Turning now to FIG. 2, the angle alpha defined by two sides 28A, 28B of the v-shaped cut out portion 28 is preferably between 80 and 120°, and in the embodiment shown is about 100°. The length X of the bottom edge 36 of the sheet, between the two V-shaped cut out portions is approximately the same length as the length Y of sides 28A, 28B of the sides of the v-shaped cut out portion 28. Similar relationships apply in relation to cut out portion 30. Length Y is approximately 20 to 25 cm long.

The angle beta defined between edge 34 and the longitudinal axis of the edge 14 of the sheet is about 10–25°, preferably about 15°.

To make the fitted sheet edges 28A and 28B of v-shaped cut-out 28 are stitched together along the dotted lines 28A', 28B' illustrated in FIG. 2 which are spaced approximately 1 cm from the edge of the sheet. Edges 30A and 30B of the opposing v-shaped cut-out 30 are also stitched together along lines 30A' and 30 B' in a similar manner.

The sheet is then turned inside out so that the stitching is on the inside. This makes the sheet appear neater although it is not essential to the invention. The bottom of the sheet is now defined by the remaining part 36 of the original transverse edge 20 of the sheet. Elastic is then stitched along edge 34, edge 36 and edge 38. This can be done by making a hem along those edges, for example a 1 cm hem having a 0.5 cm turn, inserting elastic into the hem and tensioning it. Alternatively a strip of sheet elastic can be folded around the edges 34, 36 and 38 and that elastic can be stitched to the material while the elastic is in a stretched state. In its relaxed state, the elastic should reduce the length 34-36-38 by approximately 10%.

Figure 3:
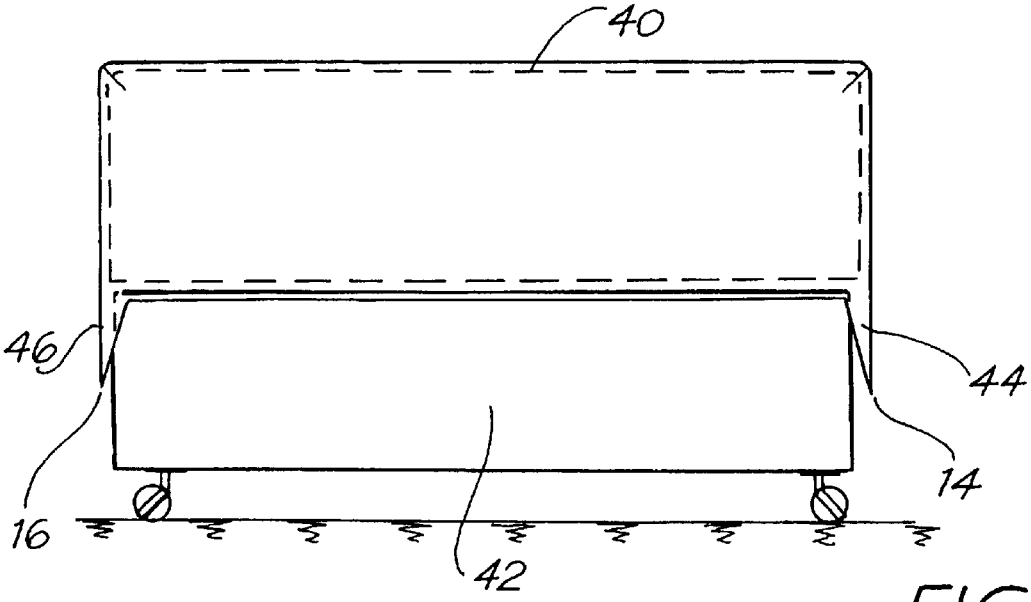
FIG. 3 is a schematic end view of a mattress to which a fitted sheet made according to the template shown in FIG. 1 is applied.

The sheet is now ready for use and when applied to the foot of a mattress the sheet is retained on the mattress partly by tension in the elastic. The stitched end portion ie the mattress engagement means and the seams 28A, 28B and 30A, 30B fit under the mattress. Thus no seams are visible looking at the end of the bed as shown in FIG. 3. The length of sheet under the bed is approximately 20 to 25 cm, ie the length of the seams. One important feature is that the elastic extends generally transversely across the mattress so that the fact that only one end of the sheet includes a retention means does not significantly effect the mattress's ability to retain the sheet in position. Fitted bottom sheets rely on tensioning the bottom sheet along diagonals, i.e. from one corner of a mattress to a diagonally opposite corner. Retention is also provided by the formed end of the sheet engaging over the end of the mattress and by friction between the bed and the mattress retaining the sheet between the two.

Figure 4:
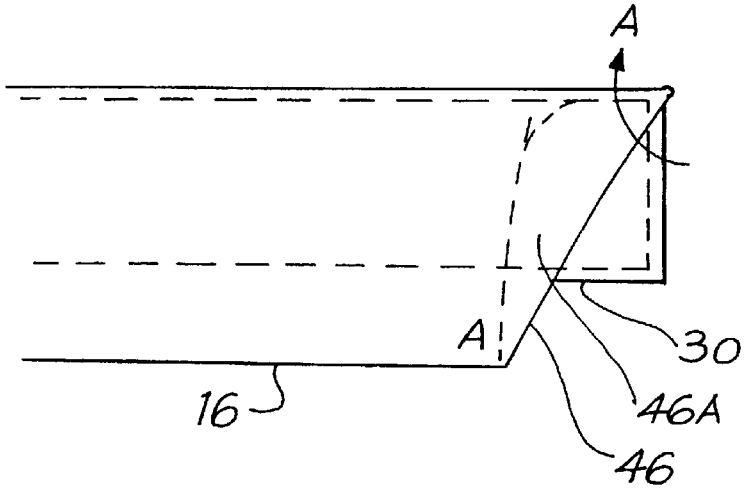
FIG. 4 is a schematic side view of the arrangement shown in FIG. 3.

As can be seen from FIGS. 3 and 4 when the sheet is applied to a mattress, indicated in phantom lines at 40, on a bed 42, the free edges 14 and 16 of the sheet hang down over the edges. The folds 44 and 46 (similar to "hospital corners") allow the edges 14 and 16 to pivot relative to the mattress engaging means in the direction of the arrow A, and thus allow room between the fitted sheet and the mattress (or any bottom sheet fitted to the mattress) so that the feet and legs of a person sleeping under the sheet 10 can move freely. Because line 46 represents a fold in the area 46A the sheet is double thickness.

Figure 5:
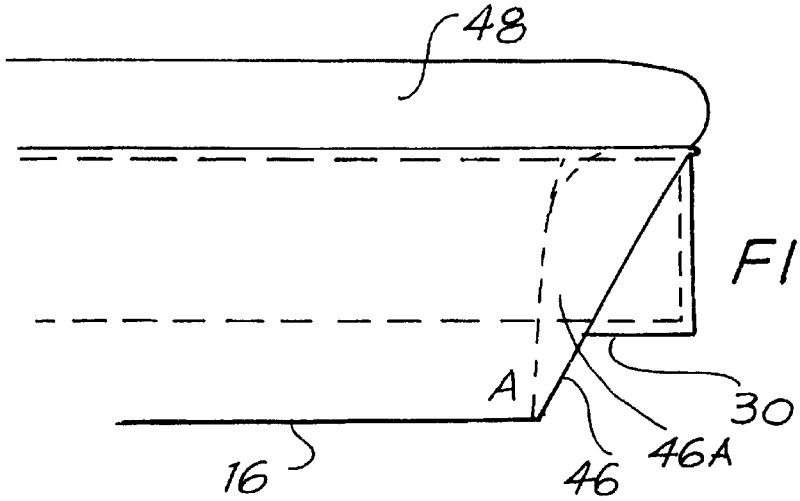
FIG. 5 is a schematic view similar to FIG. 3, of a duvet cover embodying the present invention.

Although the invention has particular application to forming fitted top sheets for mattresses, the inventor envisages that the invention might also be applied to duvet covers, blankets and similar items either by forming the engaging means from the material forming the doona cover or blanket or alternatively by making a separate mattress engaging portion having the features of end 20 of the sheet shown in FIG. 1 and stitching or otherwise applying the same to an end of the doona cover or blanket. FIG. 5 illustrates the invention applied to a duvet 48 in which a mattress engaging portion has been stitched to one side of a duvet cover.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. An item of bedclothes which includes at one end a mattress engaging means which is adapted to engage over one end of a mattress having an upper surface, said mattress engaging means being made from a sheet of flexible sheet material defining a first end having a center, two sides, and a second end having a center opposite to the first end, characterized by:

a pair of generally triangular slots formed in the first end of said sheet, the triangular slots being disposed substantially symmetrically on either side of a longitudinal axis passing though the center of the first end and the center of the second end, and being spaced apart by a distance X, the triangular slots defining an open end and two opposite sides, each side having an approximate length Y wherein the length Y is larger than, but less than twice the length X, and wherein the first end includes corner portions that are cut out along a line extending from each side at an angle of about 20° to about 40° to the longitudinal axis of each side, to the first end, thereby defining two angled edge lines;

the opposed sides of each triangular slot being joined together to form an engagement means for engaging over the end of a suitably sized mattress; and wherein elastic material is applied along the first end of the item and along each angled edge line, the elastic material being tensioned;

wherein the engagement means is attached to or integral with an item of bedclothes, whereby when the engagement means is engaged on the one end of a mattress, an area of sheet material above the mattress adjacent the engagement means is not pulled against the upper surface of the mattress by the engagement means so that said area of the sheet material is free to pivot away from the mattress, about an axis extending along the one end of the mattress at which the engagement means is engaged; and wherein the engagement means is retained on the mattress partly by tension in the engagement means which extends generally transversely across the mattress, the opposite end of the bedclothes being free from any such engagement means.

2. The item as claimed in claim 1, wherein the angle included between the two opposed sides of each triangular slot is about 80° to about 120°.

3. The item as claimed in claim 1, wherein the elastic material is tensioned to reduce the length of the edge lines and the first end by about 5% to about 15%.

4. The item as claimed in claim 1, wherein the item is a sheet and the mattress engaging means are defined by cutting and stitching one end the sheet, with elastic material be applied to the one end of the sheet.

5. The item as claimed in claim 1, wherein the length Y is greater than 20 cm.

6. The item as claimed in claim 1, wherein the length Y is between about 20 cm and about 30 cm.

7. A method of making an item of bedclothes, including the steps of:

taking a sheet of material and selecting an end of that sheet material which is to form a mattress engaging means;

cutting the sheet to form two spaced v-shaped cut-out areas in the selected end of the sheet, the v-shaped areas being generally symmetrically arranged about a longitudinal axis passing through the center of the selected end and an opposite side of the sheet;

joining the opposed sides of each v-shaped area together so that the selected end is of a reduced length substantially corresponding to the distance between the v-shaped cut-out areas;

cutting off corner portions of the first end along a line extending from each side at an angle of about 20° to about 40° to the longitudinal axis of each side, to the first end, at or adjacent the outer side of the v-shaped cut-out area, thus defining two angled edge lines; and applying elastic material along the selected end and along each angled edge line and tensioning the elastic material;

whereby, when the mattress engaging means is attached to or integral with an item of bedclothes, and the engaging means is engaged on one end of a mattress having an upper surface, an expanse of sheet material above the mattress adjacent the engaging means is not retained against the upper surface of the mattress by the engaging means, so that said expanse of sheet material is free to pivot away from the mattress, about an axis extending along the one end of the mattress at which the engaging means is engaged, and wherein the engaging means is retained on the mattress partly by tension in the engaging means which extends generally transversely across the mattress, the opposite end of the item of bedclothes being free from any such engaging means.

8. The method as claimed in claim 7, further including the steps of joining the edges of the v-shaped areas by stitching them together and turning the sheet inside-out before the step of applying the elastic material.

9. The method as claimed in claim 7, further including the step of:

tensioning the elastic material to reduce the length of the edge lines and the first end by about 5% to about 15%.

10. A fitted top sheet comprising a sheet body portion made of a sheet of flexible sheet material which is generally rectangular in shape, defining a first end having a center, two sides and a second end having a center, the second end being opposite to the first end, characterized by:

a pair of generally triangular slots formed in the first end, the triangular slots being disposed substantially symmetrically on either side of a longitudinal axis passing though the center of the first end and the center of the second end, and being spaced apart by a distance X, the triangular slots defining an open end and two opposite sides, each side having an approximate length Y wherein the length Y is larger than the distance X but less than twice the length of the distance X;

wherein the corner portions of the first end are cut along a line extending from each side at an angle of about 20° to about 40° to the longitudinal axis of each side, to the first end, thus defining two angled edge lines;

the opposed sides of each triangular slot being joined together to form an engagement means for engaging over the end of a suitably sized mattress having an upper surface, and wherein elastic material is applied along the first end and along each angled edge line, the elastic being tensioned, whereby, when the fitted sheet is engaged on one and of the mattress, an expanse of the sheet disposed above the mattress adjacent the engagement means is not pulled against the upper surface of the mattress by the engagement means, so that the sheet is free to pivot about an axis extending along the end of the mattress on which the engagement means is engaged, and wherein the engagement means is retained on the mattress partly by tension in the engagement means which extends generally transversely across the mattress.

11. The fitted sheet as claimed in claim 10, wherein the angle included between the two opposed sides of each triangular slot is about 80° to about 120°.

12. The fitted sheet as claimed in claim 10, wherein the elastic is tensioned to reduce the length of the edge lines and the first end by about 5% to about 15%.

13. The fitted sheet as claimed in claim 12, wherein the length of the edge lines and the first end is reduced by about 10%.

14. The item of bedclothes as claimed in any of claims 1 to 3, wherein the item is a cover for an article selected from the group consisting of a duvet, a doona, and an eiderdown.

* * * * *